US009117427B2

(12) United States Patent
Piccionelli et al.

(10) Patent No.: US 9,117,427 B2
(45) Date of Patent: Aug. 25, 2015

(54) DRUMSTICK CONTROLLER

(76) Inventors: Gregory A. Piccionelli, Westlake Village, CA (US); Michael M. Gerardi, Menifee, CA (US)

( * ) Notice: Subject to any disclaimer, the term of this patent is extended or adjusted under 35 U.S.C. 154(b) by 779 days.

(21) Appl. No.: 12/804,903

(22) Filed: Jul. 30, 2010

(65) Prior Publication Data

US 2011/0030533 A1 Feb. 10, 2011

Related U.S. Application Data

(60) Provisional application No. 61/273,045, filed on Jul. 30, 2009.

(51) Int. Cl.
*G10H 1/32* (2006.01)
*G10H 3/14* (2006.01)

(52) U.S. Cl.
CPC ..... *G10H 3/146* (2013.01); *G10H 2220/185* (2013.01); *G10H 2220/221* (2013.01); *G10H 2220/355* (2013.01); *G10H 2220/395* (2013.01); *G10H 2220/401* (2013.01); *G10H 2230/251* (2013.01); *G10H 2240/056* (2013.01); *G10H 2240/145* (2013.01); *G10H 2240/211* (2013.01); *G10H 2240/285* (2013.01); *G10H 2240/311* (2013.01); *G10H 2250/435* (2013.01)

(58) Field of Classification Search
USPC ..... 84/743; 446/219
See application file for complete search history.

(56) References Cited

U.S. PATENT DOCUMENTS

| | | | | |
|---|---|---|---|---|
| 4,995,294 | A * | 2/1991 | Kashio et al. | 84/738 |
| 6,626,728 | B2 * | 9/2003 | Holt | 446/219 |
| 2010/0144436 | A1 * | 6/2010 | Marks et al. | 463/36 |

* cited by examiner

*Primary Examiner* — Jianchun Qin
(74) *Attorney, Agent, or Firm* — Gregory A. Gulliver; Apogee Law Group P.C.

(57) ABSTRACT

A percussion device includes a drumstick assembly and a sleeve. The drumstick assembly includes a drumstick having a base and a tip end, and a drumstick tip secured to the tip end of the drumstick, the drumstick tip including a sensor. The sleeve is disposed about at least a portion of the drumstick including the base thereof, and includes at least one control button, a communication element, and a processor in communication with the at least one control button, the drumstick tip and the communication element. The processor is configured to receive a signal from the drumstick tip and to generate output to the communication element. The output so generated includes a signal that specifies a sound file selected by operation of the at least one control button.

11 Claims, 10 Drawing Sheets

DRUMSTICK CONTROLLER

This application is based on U.S. Provisional Patent Application Ser. No. 61/273,045, filed Jul. 30, 2009, the entire disclosure of which is incorporated herein by reference.

FIELD OF THE INVENTION

The present invention relates to improved drumsticks, and in particular drumsticks incorporating sensors and processors that enable a player to generate a variety of sounds and sound effects. The present invention further relates to methods for producing a musical performance that make use of such drumsticks.

BACKGROUND OF THE INVENTION

Drumsticks have been used for centuries to strike drums and other percussion instruments in order to generate drum beats, cymbal clashes and other percussive sounds. During that time, the basic structure of the drumstick has remained relatively unchanged.

Modern developments in electronics and data processing have made possible improvements in musical instruments such as the harpsichord (see, e.g., U.S. Pat. No. 6,967,270, to Gerardi et al., incorporated herein by reference), and stringed instruments (see, e.g., U.S. patent application Ser. No. 12/660,038, filed Feb. 18, 2010, incorporated herein by reference) which afford performers new modes of performance.

A need exists for an improved drumstick that incorporates electronic components and affords performers new ways of producing musical performances.

SUMMARY OF THE PREFERRED EMBODIMENTS

In accordance with one aspect of the present invention, there is provided a percussion device (or "drumstick controller") including a drumstick assembly and a sleeve. The drumstick assembly includes a drumstick having a base and a tip end, and a drumstick tip secured to the tip end of the drumstick, the drumstick tip including a sensor. The sleeve is disposed about at least a portion of the drumstick including the base thereof, and includes at least one control button, a communication element, and a processor in communication with the at least one control button, the drumstick tip and the communication element. The processor is configured to receive a signal from the drumstick tip and to generate output to the communication element. The output so generated includes a signal that specifies a sound file selected by operation of the at least one control button.

In certain particular embodiments, the sensor is responsive to contact with a surface and generates a signal when the drumstick tip contacts a surface. In other particular embodiments, the includes a location-determination device and generates a signal when the location of the drumstick tip is determined to be with a specified area.

According to more particular embodiments, the processor includes a memory element, such as a RAM or other solid-state device, encoded with at least one sound file. In such embodiments, the output signal includes a signal specifying the selected sound file. In very particular embodiments, the output signal encodes the selected sound file itself.

In particular embodiments, the percussion device includes a plurality of control buttons. In more particular embodiments, the percussion device includes a first plurality of control buttons arranged on a first portion of the sleeve and a second plurality of control buttons arranged on a second portion of the sleeve. In specific embodiments, the sleeve is configured to conform to a hand of a human user such that the first plurality of control buttons is operable by at least one finger of the human user and the second plurality of control buttons is operable by a thumb of the human user.

According to particular embodiments, the communication element is a transmitter, or more particularly a transmitter/receiver.

In specific embodiments, the output signal causes an external synthesizer to produce the selected sound file.

In accordance with another aspect of the present invention, there is provided a percussion device including a drumstick assembly as described above, and a sleeve. The sleeve includes at least one control button, a speaker, and a processor in communication with the at least one control button, the drumstick tip and the speaker. The processor is configured to receive a signal from the drumstick tip and to generate output to the speaker. The output comprises a sound file selected by operation of the at least one control button. In particular embodiments, the processor includes a memory element encoded with at least one sound file. In such embodiments, the output comprises the sound fil(s) selected from memory.

In particular embodiments, the percussion device further includes a microphone disposed in the sleeve and in communication with the processor.

In accordance with still another aspect of the present invention, there is provided a system for producing a musical performance. The system includes a percussion device as described above in which the sleeve includes a communication element; a synthesizer; and a speaker in communication with the synthesizer. The synthesizer is programmed with at least one sound file, and further includes a receiver configured to receive a signal from the communication element of the percussion device. The synthesizer is configured to produce a sound file specified by the output from the processor of the percussion device.

Other features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which FIGS. 1A-C are partial cut-away views of a drumstick controller according to a first embodiment of the invention, wherein FIG. 1A is a side view, FIG. 1B is a distal end view in the direction indicated by arrow A-A', and FIG. 1C is a proximal end view in the direction indicated by arrow B-B'.

Like numerals refer to like parts throughout the several views of the drawings.

DETAILED DESCRIPTION OF THE PREFERRED EMBODIMENTS

Figure 1A:
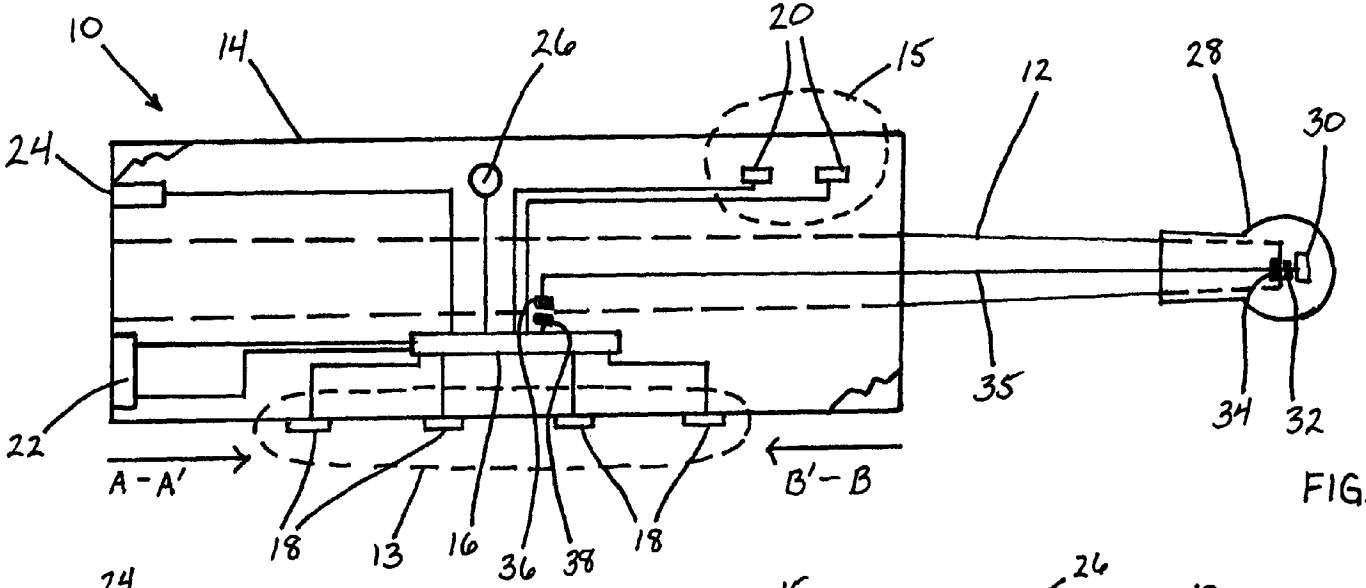
Figure 1C:
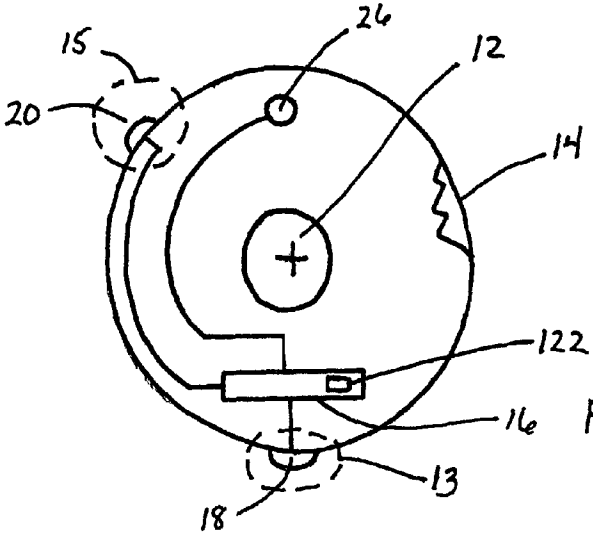
Figure 1B:
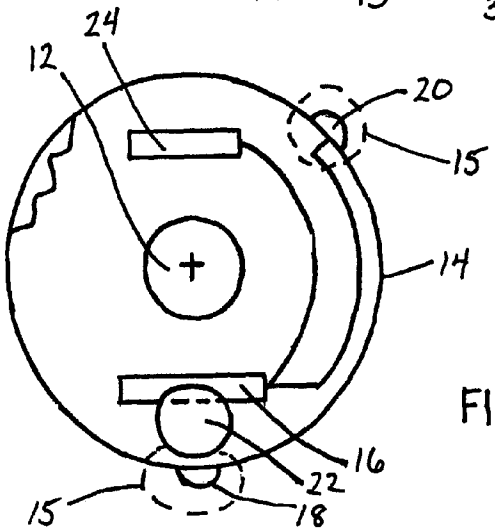

Referring to FIGS. 1A-C, percussion device 10, which will be referred to as a "drumstick controller", includes drumstick 12 with proximal end 12*a* and distal end 12*b* partially surrounded by sleeve 14. Processor 16 incorporated within sleeve 14 communicates with at least one control button. In specific embodiments, a first set of one or more control buttons is arranged on a first portion 13 of sleeve 14, and a second set of one or more control buttons is arranged on a second portion 15 of sleeve 14 such that the first set is operable by the fingers of a user while the second set is operable by the thumb of a user. The illustrated embodiment includes four finger control buttons 18 and two thumb control buttons 20; however, any desired number of control buttons can be included in various embodiments, and various arrangements and configurations of control buttons can be produced as desired. Furthermore, any desired component capable of providing a signal to processor 16, including without limitation switches, touchpads and the like, can be employed.

Battery 20 provides electrical power to processor 16 and other components of drumstick controller 10. Alternatively, electrical power can be provided by other conventional means such as power cords (not shown).

Processor 16 produces output that is used to generate various sounds and/or sound effects. The output from processor 16 is conveyed, in various embodiments, to an external synthesizer via communication elements such as a USB cable received in USB port 24, a short-range transmitter/receiver 26 (or in alternative embodiments, a transmitter), a MIDI cable, or other conventional means as desired.

In particular embodiments, processor 16 includes a memory 122 (see FIGS. 1C, 8B), such as a RAM or other solid-state device, in which at least one sound file is encoded and stored. In more specific embodiments, a plurality of sound files are so encoded and stored, affording a user a variety of possible sounds for generation according to the invention. In such embodiments, the output signal includes a signal specifying the selected sound file. In very particular embodiments, the output signal encodes the selected sound file itself.

Drumstick tip 28 is secured to drumstick 12. In particular embodiments, drumstick tip 28 is replaceable and is removably secured to drumstick 12. In other particular embodiments, drumstick tip 28 is formed integrally with drumstick 12. Drumstick tip 28 incorporates drumstick sensor 30 in communication with sensor contact 32. Sensor contact 32 contacts drumstick sensor contact 34 and communicates via sensor line 35 (which can be defined within drumstick 12, as illustrated, or alternately, mounted on a surface of drumstick 12) with drumstick sleeve contact 36. Drumstick sleeve contact 36 in turn contacts sleeve contact 38, which communicates with processor 16. Thus, signals from drumstick sensor 30 are communicated to processor 16. In alternate embodiments, signals from drumstick sensor 30 are communicated wirelessly to processor 16.

Figure 2:
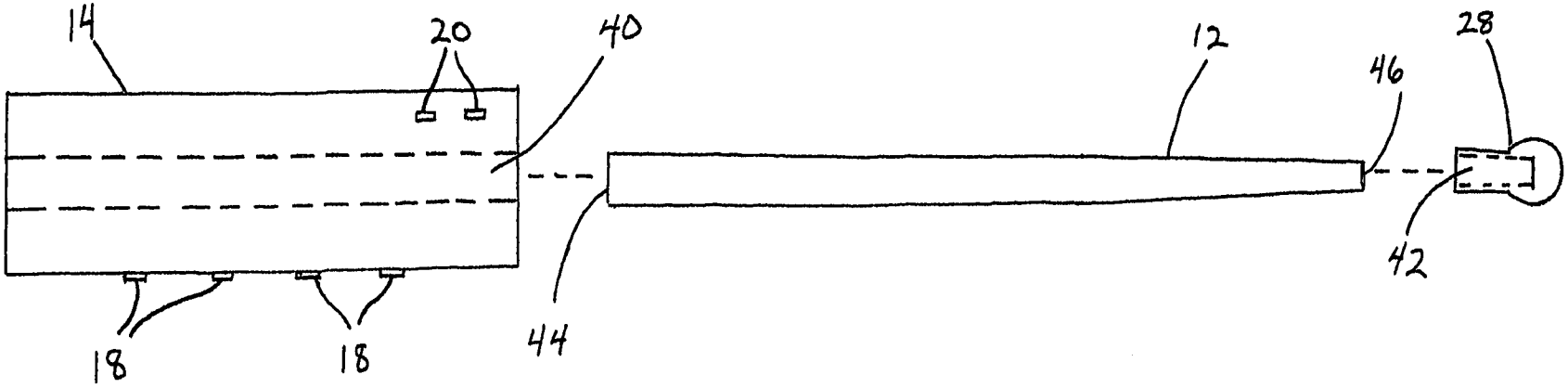
FIG. 2 is an exploded view of the embodiment of FIGS. 1A-C, FIGS. 3A-C illustrate a method for producing a musical performance making use of a drumstick controller as illustrated in FIGS. 1A-C, in which a single control button is depressed by the user.

FIG. 2 illustrates assembly of a drumstick controller as described above. Drumstick 12 is received within sleeve cavity 40 defined in sleeve 14, with drumstick base 44 inserted into sleeve cavity 40 and drumstick tip end 46 inserted into drumstick tip cavity 42. In the embodiments of FIGS. 1A-C, when sleeve 12 and drumstick 28 are secured to drumstick 12 as described, contacts 32 and 34 are brought into communication, as are contacts 36 and 38.

Figure 3A:
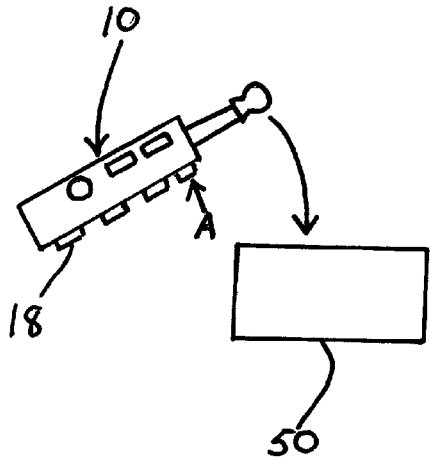
Figure 3B:
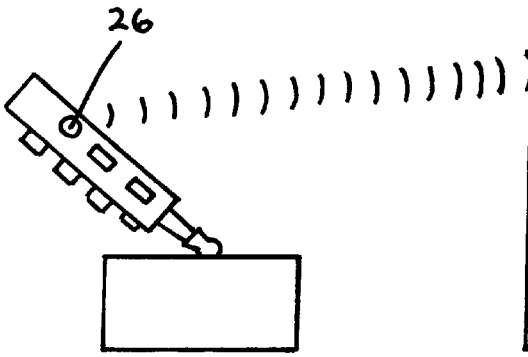
Figure 3C:
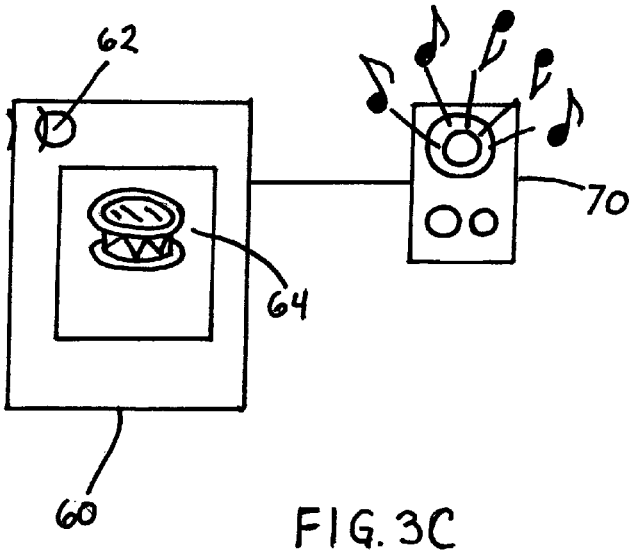

Turning now to FIGS. 3A-C, a first method for producing a musical performance employing a drumstick controller as described herein is illustrated. In FIG. 3A, a performer grasping drumstick controller 10 begins a movement of drumstick controller 10 toward surface 50 in order to bring drumstick tip 28 into contact with surface 50. Surface 50 can be any solid surface. Non-limiting examples include a drum pad, a table top, a floor, a wall, or even the body of another performer. While grasping drumstick controller 10, the performer depresses one of finger control buttons 18 (indicated by arrow A).

In FIG. 3B, the performer brings drumstick tip 28 into contact with surface 50. Sensor 30 within drumstick tip 28 (see FIG. 1A) detects the contact, and produces a signal which is communicated to processor 16 of drumstick controller 10 (see FIG. 1A). In response to the signal from sensor 30, processor 16 generates output which is communicated to short-range transmitter/receiver 26 and transmitted to short-range receiver 62 within synthesizer 60. In response to the output received from processor 16, synthesizer 60 causes a sound file to be produced from speaker 70, as shown in FIG. 3C.

The sound file played by synthesizer 60 from speaker 70 can be any desired sound file. Sounds that can be produced by synthesizer 60 in response to the output from processor 16 include, without limitation, musical tones, sound effects (e.g., crashes, industrial machinery, automobile horns, etc.), loops, stored Midi files, and the like. Files producing single notes or beats produced by a single musical instrument can be played in response to the output from processor 16 generated by a single contact of drumstick tip 28 on surface 50, in particular embodiments. In such embodiments, when the performer causes drumstick 28 to contact surface 50, a single drum beat is generated by synthesizer 60 and played from speaker 70. In particular embodiments, an icon 64 (as shown, a drum icon) can be produced corresponding to the musical instrument or other sound source played, and can be provided to the performer, for example via a heads-up display (HUD).

Alternatively, continuous loops or other extended-duration sound files can be produced, and can, in various embodiments, continue until a subsequent signal is received from sensor 30 and/or until one or more control buttons 18, 20 are depressed, continue for the duration of the performance, etc.

Figure 4A:
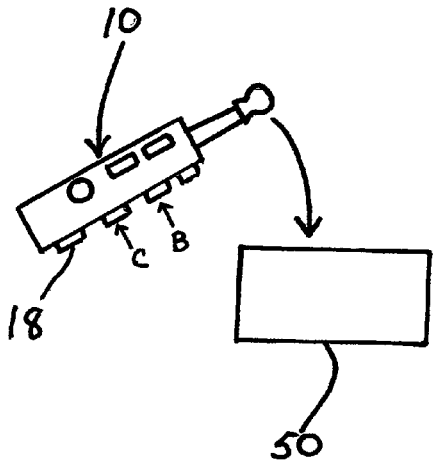
FIGS. 4A-C illustrate a method for producing a musical performance making use of a drumstick controller as illustrated in FIGS. 1A-C, in which a plurality of control buttons are depressed by the user.
Figure 4B:
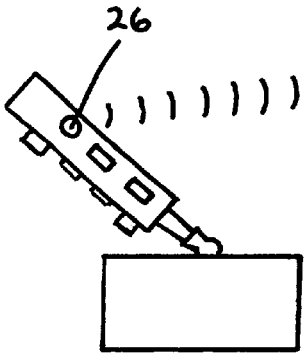
Figure 4C:
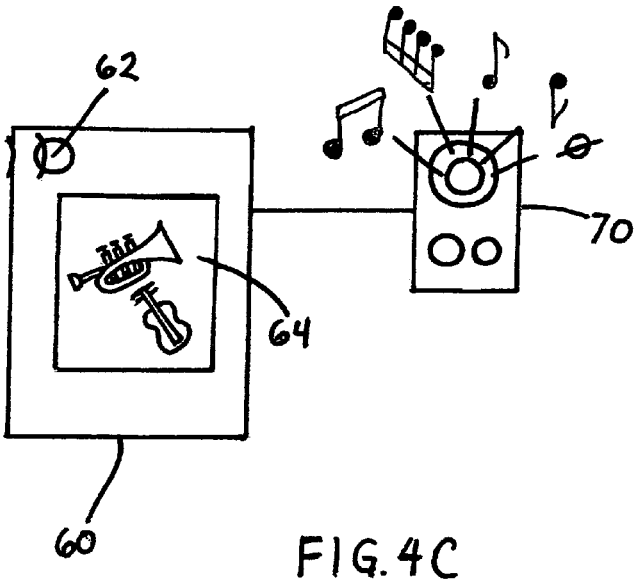

In FIGS. 4A-C, a performer likewise grasps drumstick controller 10 and directs drumstick tip 28 into contact with surface 50. In this embodiment, however, the performer depresses a plurality of finger control buttons 18 (indicated by arrows B and C). Contact with surface 50 results in two sound files being played through speaker 70 (as indicated by icons 64 for a trumpet and violin in FIG. 4C).

In other particular embodiments, one or more control buttons of drumstick controller 10 can be used to produce sound files directly, without contact between drumstick tip 28 and surface 50. Such embodiments can be combined, with certain sound files being played in response to contact between drumstick tip 28 and surface 50 and other sound files being played in response to depression of one or more finger control buttons 18 and/or thumb control buttons 20. Such embodiments afford the performer new modes for producing musical performances.

In additional embodiments, a performer employs two drumstick controllers 10, one in each hand.

Figure 5:
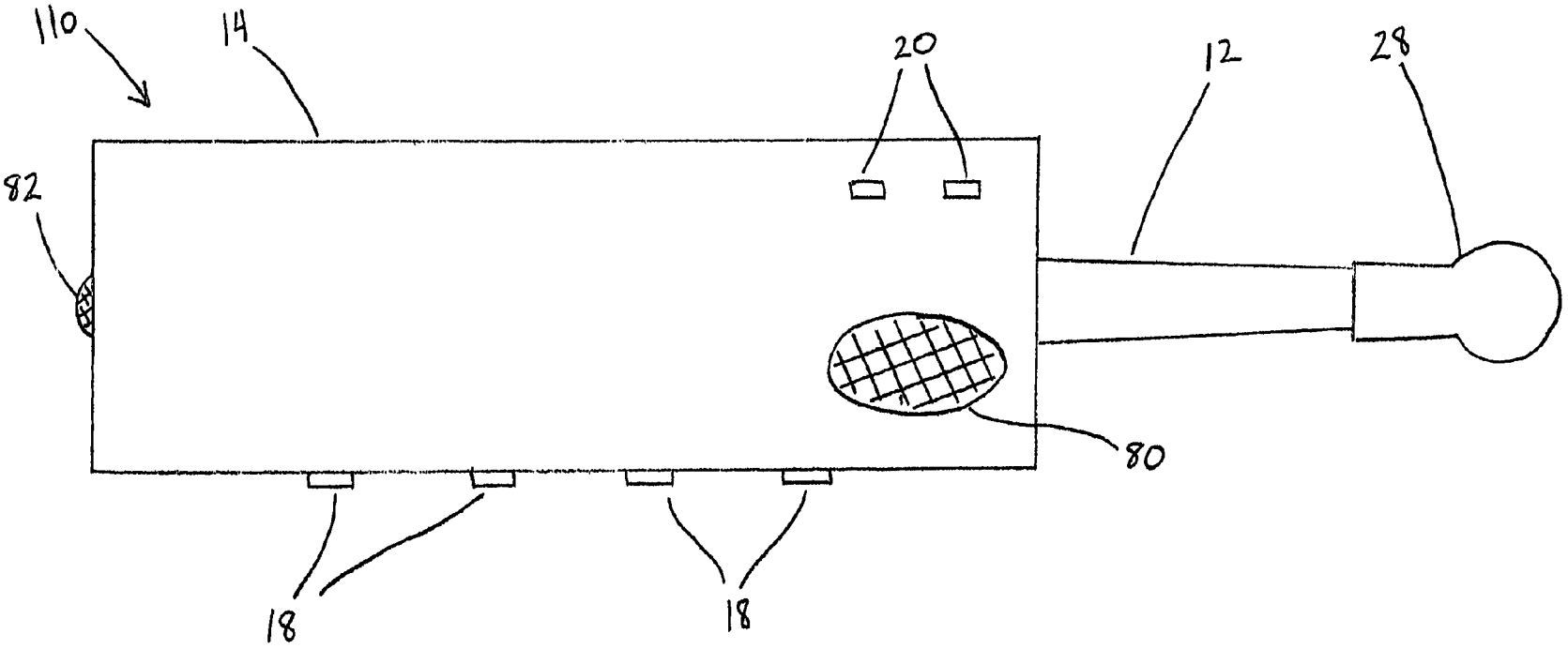
FIG. 5 is a side elevation view of a drumstick controller according to a second embodiment of the invention that incorporates a speaker and microphone.
Figure 6A:
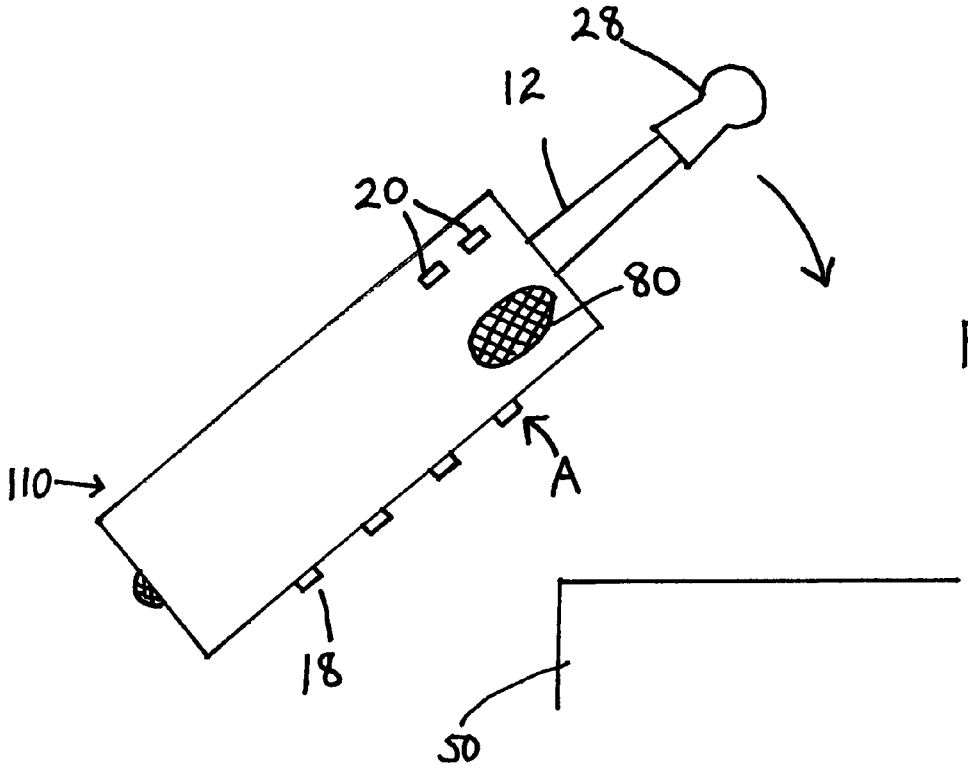
FIGS. 6A-B illustrate a method for producing a musical performance making use of a drumstick controller as illustrated in FIG. 5, in which music so produced is played through a speaker incorporated into the drumstick controller.
Figure 6B:
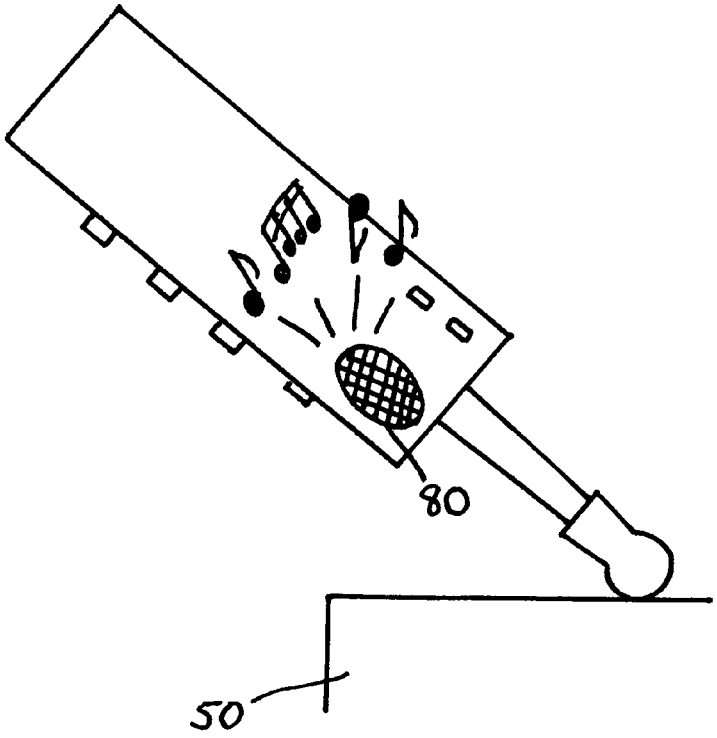

FIG. 5 illustrates an alternative embodiment of a percussion device (drumstick controller) 110 that incorporates speaker 80 and microphone 82. This embodiment enables the performer to produce a musical performance without the need for a separate synthesizer; in such embodiments, processor 16 includes tone-generation and/or memory components for synthesizing and/or reproducing sound files in response to contact between drumstick tip 28 and surface 50, as well as in response to depression of control buttons 18, 20. Microphone 82 further enables a performer to add a vocal component to his or her performance. As shown in FIGS. 6A-B, contact of drumstick tip 28 with surface 50 results in a sound file being played through speaker 80 of drumstick controller 110.

Figure 7A:
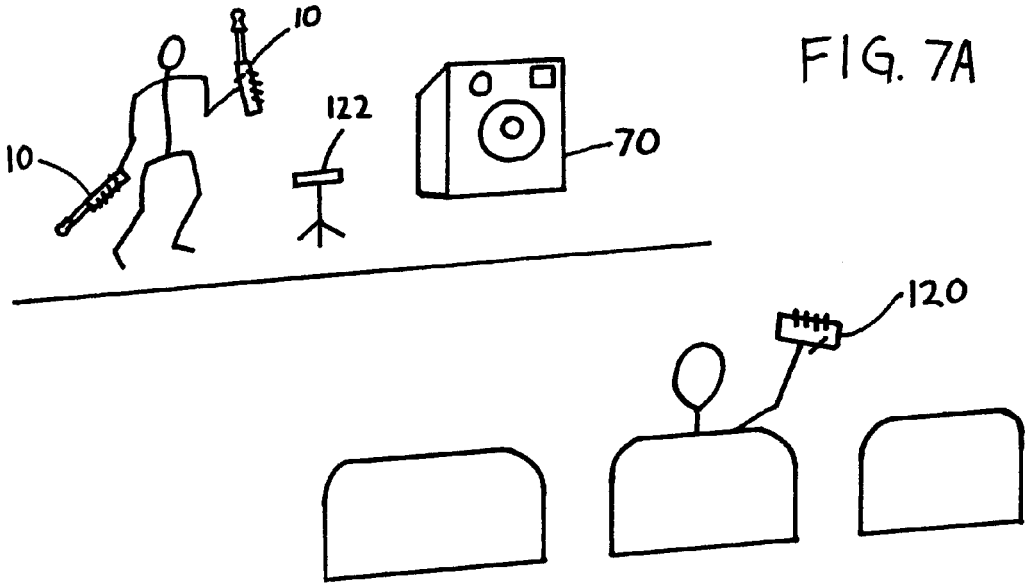
FIGS. 7A-B illustrate a method of producing a musical performance using embodiments of drumstick controllers according to the invention, which method allows for audience participation in the performance.
Figure 7B:
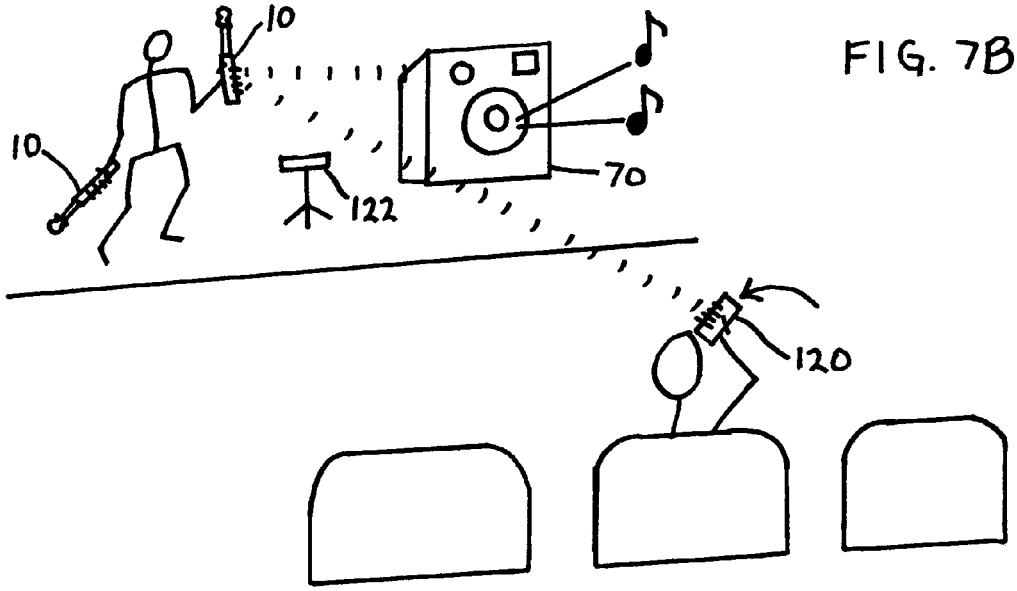

Embodiments of the foregoing percussion device afford new and creative methods of producing and/or recording musical performances. For example, use of embodiments of the inventive percussion device together with appropriately configured and programmed auxiliary devices in the possession of audience members allows the audience members themselves to participate in the performance of a performer employing the inventive drumsticks. Thus, in FIGS. 7A-B, an audience member has in his possession a telecommunication device 120, such as an i-Phone® or other smartphone, or any other device capable of receiving and downloading applications. A performer makes available to the audience member, for example, directly or via a site on a network, such as an Internet website, with which the performer is associated, an application that enables telecommunication device 120 to function as a remote drumstick. Exemplary applications make use, for example, of GPS devices, motion sensors, accelerometers or other elements of telecommunication device 120 that allow the location and/or motion of the device to be determined. The audience member downloads the application into telecommunication device 120.

Once downloaded, motions of telecommunication device 120 (FIG. 7B, indicated by arrow A) are detected and converted to signals, which are transmitted to drumsticks 10 used by the performer. The signals are received by drumstick controllers 10 (via transmitter/receiver 26, see FIG. 1A), and processed by processor 16 as if they had been generated by sensor 30 of drumstick controllers 10 (see FIG. 1A). A musical performance is then produced from speaker 70 in a manner similar to that illustrated in FIGS. 3A-B, as if by physical motions of the performer himself using drumstick controllers 10, e.g., to contact drumming surface 122.

In such embodiments, the performer can operate various of control buttons 18, 20 to determine the particular nature of the sounds generated. In a first alternative embodiment, the application downloaded to telecommunication device 120 further enables the audience member to select one or more sounds to be generated by the simulated motion of drumstick controllers 10.

In another alternative embodiment, rather than transmitting motion information from telecommunication device 120, only sound selections are transmitted. The audience member in effect selects which control buttons 18, 20 are to be activated during the performer's performance. In such embodiments, the audience member thus specifies the sound to be generated by the performer's physical movement of drumsticks 10.

Figure 8A:
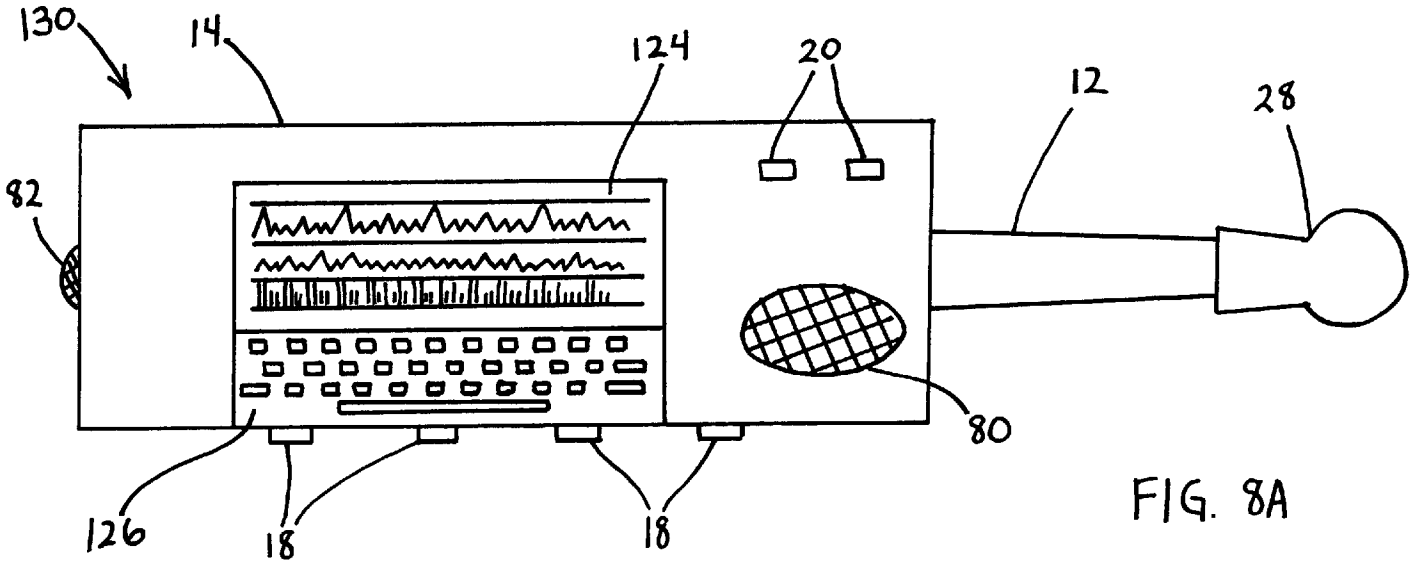
FIGS. 8A-B illustrate a "studio in a stick" embodiment of a drumstick controller according to the invention, which enables a performer to produce and record a complete multi-track performance.
Figure 8B:
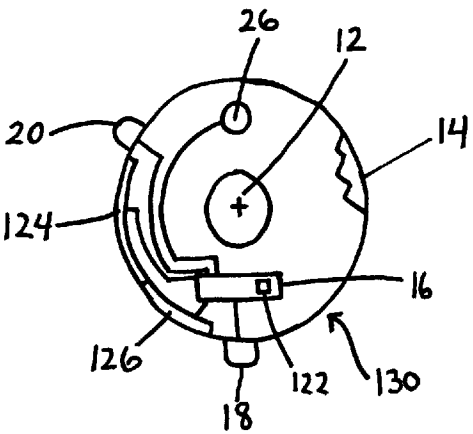

In more particular embodiments, processor 16 of drumstick controllers 10, 110 include memory components 122 for recording performances produced by a performer using the drumstick controllers. FIGS. 8A-B illustrate a further embodiment of such a drumstick controller 130, including speaker 80 and microphone 82 as in FIG. 5, memory 122, and display screen 124, on which a visual display of one or more audio, vocal, instrumental and/or percussion tracks are produced. Display screen 124 communicates with processor 16. Such embodiments may be referred to as "studio in a stick" embodiments: by appropriate selection of instruments (percussive or melodic) and other sound files via control buttons 18, 20, multiple instrumental tracks are produced as described above; such tracks are then recorded and stored in memory 122, from which they are combined, optionally with additional vocal tracks produced using microphone 82, and further processed by processor 16 using appropriate software. The software for manipulating and combining the various tracks can be accessed and utilized using, in certain embodiments, a small keyboard 126 secured in sleeve 14. In other embodiments, an external keyboard or other access device can be used; in such embodiments, jacks, wireless communication devices or the like are advantageously employed to provide communication between the access device and processor 16. In this way, entire multitrack recordings are produced using a single device, namely drumstick controller 130. In additional more specific embodiments, drumstick controller 130 and a second drumstick controller (such as controller 10, 110 or 130) are used to create one or more instrumental tracks, which are subsequently combined into one multitrack recording.

Embodiments of the inventive percussion device can be used in conjunction with other musical instruments. For example, a performer can use a pair of drumstick controllers according to the invention to strike the keys of a keyboard instrument, in particular a strummable electric harpsichord as disclosed in Gerardi et al., U.S. Pat. No. 6,967,270, thereby producing both notes from the harpsichord and selected sounds using the drumsticks. A further example makes use of an instrument as disclosed in Piccionelli et al., U.S. patent application Ser. No. 12/660,038, in which the strings of the instrument disclosed therein are struck by a drumstick controller as described above. A still further example modifies the instrument disclosed in Piccionelli et al. '038 to supplement, or replace, the keyboard component of the instrument (element 16 of FIGS. 1a-b of the '038 application) with a drum pad; processor 32 of the '038 application is provided with appropriate drum pad software. The drum pad of the modified instrument is struck with a drumstick as described herein by the performer during the course of his performance. The foregoing examples enable the performer to simultaneously produce music from as many as three different sources (strings, keyboards and percussion).

Figure 9:
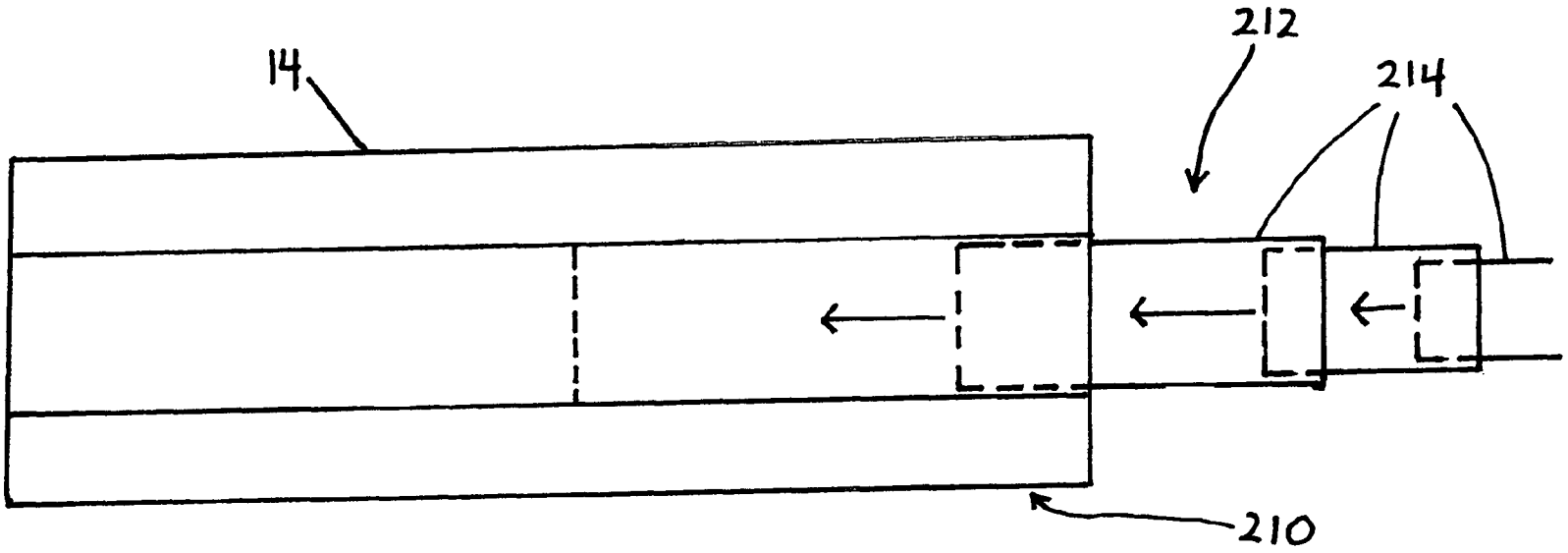
FIG. 9 is a partial cutaway view of an embodiment of a drumstick controller including a collapsible stick.

A further embodiment of a percussion device according to the invention employs a collapsible stick. In FIG. 9, drumstick controller 210 includes collapsible drumstick 212 comprised of a plurality of nested telescoping elements 214. This configuration affords a more compact and easily transportable device.

Figure 10A:
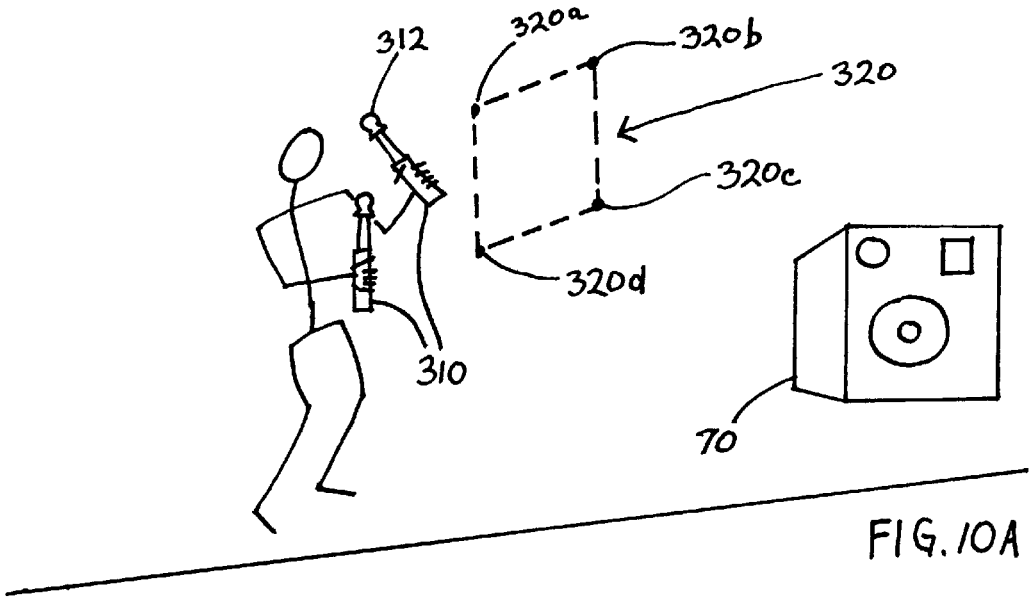
FIGS. 10A-B illustrate a method of producing a musical performance using an alternative embodiment of a drumstick controller of the invention having a tip equipped with a location determination device. Use of such drumstick controllers enables a performer to produce sounds by causing the drumstick tip to enter a specified area of space rather than contact a physical surface.
Figure 10B:
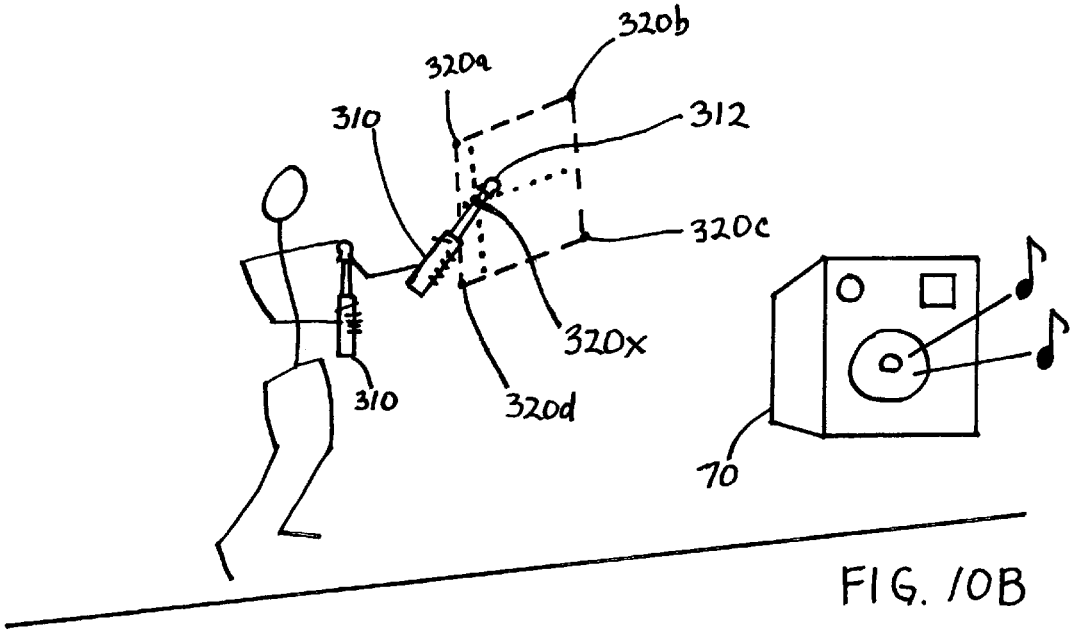

The foregoing percussion device embodiments have been described with reference to contact with a surface, which contact is detected by sensor 30. Alternative embodiments of devices according to the invention operate when the tip 28 of drumstick 12 is determined to enter a specified spatial location. Referring to FIGS. 10A-B, a performer wields drumstick controllers 310 equipped with tips 312 that include location determination devices, such as GPS elements or other devices allowing determination of the location of the drumstick tips. Area 320, as illustrated a square having corners 320*a-d*, is defined by, for example, GPS coordinates or any other system for location points in space, and provides a virtual drumming surface (FIG. 10A). When the performer moves a drumstick controller 310 in order to "strike" the virtual drumming surface defined by area 320 (FIG. 10B), tip 312 passes through area 320, for example at point 320*x*. When it is determined that tip 312 has entered area 320, a signal is generated which is communicated to the processor (not shown) of drumstick controller 310, in a manner similar to foregoing embodiments. One or more sound files are then produced through speaker 70 in a manner as previously described.

In various embodiments of the inventive percussion device, drumstick 12 is formed from wood or another rigid material, such as a plastic material. Collapsible drumstick 212, in various embodiments, is formed from a metal, such as aluminum, an alloy of two or more metals and other elements, a plastic material, etc. Sleeve 14, in various embodiments, is formed from a resilient material such as a polyurethane foam or other foamed material, a molded material such as a thermoplastic, or in other embodiments, comprises a plurality of layers of materials having differing rigidities.

We claim:

1. A percussion device comprising:
- a) a drumstick assembly comprising
  - i) a drumstick having a base and a tip end, and
  - ii) a drumstick tip secured to the tip end of the drumstick, the drumstick tip comprising a sensor, and
- b) a sleeve having defined therein a sleeve cavity, the sleeve cavity being occupied by at least a portion of the drumstick including the base thereof, the sleeve comprising
  - i) at least one control button,
  - ii) a communication element, and
  - iii) a processor in communication with the at least one control button, the drumstick tip and the communication element, the processor being configured to receive a signal from the drumstick tip and to generate output to the communication element,
  - wherein the output comprises a signal that specifies a sound file selected by operation of the at least one control button.

2. The percussion device of claim 1 wherein the sensor is responsive to contact with a surface and generates a signal when the drumstick tip contacts a surface.

3. The percussion device of claim 1 wherein the sensor comprises a location-determination device and generates a signal when the location of the drumstick tip is determined to be with a specified area.

4. The percussion device of claim 1 wherein the processor comprises a storage element encoded with at least one sound file, and wherein the output signal comprises a signal encoding the selected sound file.

5. The percussion device of claim 1 comprising a plurality of control buttons.

6. The percussion device of claim 5 comprising a first plurality of control buttons arranged on a first portion of the sleeve and a second plurality of control buttons arranged on a second portion of the sleeve.

7. The percussion device of claim 6 wherein the sleeve is configured to conform to a hand of a human user such that the first plurality of control buttons is operable by at least one finger of the human user and the second plurality of control buttons is operable by a thumb of the human user.

8. The percussion device of claim 1 wherein the communication element is a transmitter.

9. The percussion device of claim 8 wherein the communication element is a combined transmitter and receiver.

10. The percussion device of claim 1 wherein the output signal causes an external synthesizer to produce the selected sound file.

11. A system for producing a musical performance comprising
- a) a percussion device comprising
  - i) a drumstick assembly comprising
    - A) a drumstick having a base and a tip end,
    - B) a drumstick tip secured to the tip end of the drumstick, the drumstick tip comprising a sensor, and
  - ii) a sleeve having defined therein a sleeve cavity, the sleeve cavity being occupied by at least a portion of the drumstick including the base thereof, the sleeve comprising
    - A) at least one control button,
    - B) a communication element, and
    - C) a processor in communication with the at least one control button, the drumstick tip and the communication element, the processor being configured to receive a signal from the drumstick tip and to generate output to the communication element,
    - wherein the output comprises a signal that specifies a sound file selected by operation of the at least one control button,
- b) a synthesizer programmed with at least one sound file, the synthesizer further comprising a receiver configured to receive a signal from the communication element of the percussion device, wherein the synthesizer is configured to produce a sound file specified by the output from the processor of the percussion device, and
- c) a speaker in communication with the synthesizer.

* * * * *